US005246824A

United States Patent [19]

Delfino et al.

[11] Patent Number: 5,246,824

[45] Date of Patent: Sep. 21, 1993

[54] LIGHT-SENSITIVE SILVER HALIDE PHOTOGRAPHIC ELEMENTS

[75] Inventors: Gerolamno Delfino; Riccardo Gallesio, both of Savona, Italy

[73] Assignee: Minnesota Mining and Manufacturing Company, St. Paul, Minn.

[21] Appl. No.: 823,757

[22] Filed: Jan. 22, 1992

[30] Foreign Application Priority Data

Jan. 28, 1991 [IT] Italy ..... MI91A000202

[51] Int. Cl.[5] ..... G03C 1/005; G03C 1/494

[52] U.S. Cl. ..... 430/567; 430/621; 430/622; 430/642; 430/502

[58] Field of Search ..... 430/622, 642, 965, 567, 430/502

[56] References Cited

U.S. PATENT DOCUMENTS

| | | | |
|---|---|---|---|
| 4,411,986 | 10/1983 | Abbott et al. | 430/502 |
| 4,414,304 | 11/1983 | Dickerson | 430/353 |
| 4,425,425 | 1/1984 | Abbott et al. | 430/502 |
| 4,490,458 | 12/1984 | House | 430/550 |
| 4,607,004 | 8/1986 | Ikenoue et al. | 430/622 |
| 4,647,528 | 3/1987 | Yamada et al. | 430/621 |
| 4,847,189 | 7/1989 | Suzuki et al. | 430/567 |
| 5,026,632 | 6/1991 | Baghi et al. | 430/961 |
| 5,066,572 | 11/1991 | O'Connor et al. | 430/539 |

FOREIGN PATENT DOCUMENTS 2009433 6/1979 United Kingdom .

*Primary Examiner*—Charles L. Bowers, Jr.
*Assistant Examiner*—Geraldine Letscher
*Attorney, Agent, or Firm*—Gary L. Griswold; Walter N. Kirn; Mark A. Litman

[57] ABSTRACT

Light-sensitive silver halide photographic elements are disclosed comprising a support and silver halide emulsion layer or layers, wherein at least one of said silver halide emulsion layers contains tabular silver halide grains having an average diameter:thickness ratio of at least 3:1 and highly deionized gelatin hardened with a compound of formula $(CH_2{=}CH{-}SO_2{-})_n{-}A$, wherein A is an n-valent organic group containing at least one hydroxy group and n is 2,3 or 4.

The light-sensitive materials can be advantageously used in high temperature processing in automatic processors which include transporting rollers and have good characteristics of resistance to pressure marking.

15 Claims, No Drawings

LIGHT-SENSITIVE SILVER HALIDE PHOTOGRAPHIC ELEMENTS

FIELD OF THE INVENTION

This invention relates to light-sensitive silver halide photographic elements and, more particularly, to light-sensitive silver halide photographic elements comprising tabular silver halide grains for rapid processing in automatic processors which include transport rollers.

BACKGROUND OF THE INVENTION

Tabular silver halide grains are crystals possessing two major faces that are substantially parallel. The average diameter of said faces is at least three times the distance separating them (the thickness), this is generally described in the art as an aspect ratio of at least 3.

Silver halide photographic emulsions containing a high proportion of tabular grains have advantages of good developability, improved covering power and increased useful adsorption of sensitizing dye per weight of silver due to their high surface area-to-volume ratio. The use of such emulsions in photographic elements is disclosed in U.S. Pat. Nos. 4,425,425, 4,425,426, 4,433,048, 4,435,499, 4,439,520, and other related patents.

The use of automatic processors for the rapid processing of light-sensitive silver halide elements including tabular silver halide grains, in particular light-sensitive silver halide elements for radiographic use, is known. Such elements generally include a support (usually provided with a very thin subbing layer) having coated on at least one side a silver halide gelatin emulsion layer coated in turn with a gelatin protective layer. These elements are transported through the machine processing units (developing, fixing, washing and drying) by means of opposed or staggered rollers (as described, for example, in U.S. Pat. No. 3,025,779) which also have the function of sqeezing liquid from the film prior to drying. In order to reduce the time taken by the element to pass through the processing machine to 0.5 to 2 minutes, as particularly required in rapid processing of radiographic elements, the processing is performed at relatively high temperatures, usually higher than 30° C., preferably between 35° and 45° C., such as 38° C., and the gelatin content of the silver halide emulsions is considerably reduced as compared with that of emulsions for manual processing.

Under such conditions, even with the changes in the emulsions, the physical and photographic properties of the elements processed in an automatic processor tend to be worse. With high temperatures and in presence of such low gelatin content, for instance, the intrinsic sensitivity to pressure of the silver halide grains gets higher and the elements processed in the automatic processor show marks caused by the pressure of the transporting rollers. Such pressure marks look like higher density regions and reduce the image faithfulness.

In order to prevent pressure marking, various methods have been described in the art. To this purpose, U.S. Pat. No. 2,960,404 describes the use in the photographic elements of glycerine, ethylene glycol and the like, Japanese Pat. No. 5316/1972 describes the use of 1,4-cyclohexane dimethanol and the like, and Japanese Pat. No. 4939/1978 describes the use of trimethylol propane. Another possible method of preventing pressure marking is by increasing the degree of hardening of the gelatin layers, in particular of the external protective layers.

As another method, photographic elements are known wherein an intermediate gelatin layer is interposed between the support and the emulsion layer. For example, U.S. Pat. No. 3,637,389 describes a rapid processing photographic element wherein gradation, density and sensitivity are improved by applying such an intermediate gelatin layer between the support and the emulsion layer.

However, known methods of preventing pressure marking when used in photographic elements including tabular silver halide grains have proved less effective. Accordingly, the problem still remains of preventing pressure marking in photographic elements including light-sensitive tabular silver halide emulsions.

U.S. Pat. No. 4,414,304 describes forehardened photographic elements, particularly radiographic elements, including at least one hydrophilic colloid emulsion layer containing tabular silver halide grains. The element require no additional hardening on development and give images of high covering power. Among gelatin hardeners, bis(vinylsulfonylmethyl) ether, mucochloric acid and formaldehyde are described.

Japanese patent application no. J5 9105-636 describes photographic elements comprising at least one silver halide emulsion layer containing tabular silver halide grains, the binder of at least one of the hydrophilic colloidal layers being gelatin which has jelly strength of at least 250 g. Wet coat strength of said elements is improved without reducing covering power.

DE patent application no. 3,433,893 describes photographic elements containing tabular silver halide grains and a polymeric hardener. The elements have increased resistance to scratching during wet processing and good covering power.

Japanese patent application no. J6 2249-140 describes photographic elements comprising at least one silver halide emulsion layer containing tabular silver halide grains and halogen substituted s-triazine type hardeners. The elements are suitable for rapid processing and have improved pressure resistance.

U.S. Pat. No. 4,847,189 describes a photographic element comprising at least one silver halide emulsion layer containing tabular silver halide grains, the melting time and the gelatin amount of the element being such as to render the element suitable for rapid processing and improve the pressure desensitization resistance.

SUMMARY OF THE INVENTION

There is provided by the present invention a light-sensitive silver halide photographic element comprising a support and at least one silver halide emulsion layer, wherein at least one silver halide emulsion layer contains tabular silver halide grains having an average diameter:thickness ratio of at least 3:1 and highly deionized gelatin hardened with a compound of formula $(CH_2{=}CH{-}SO_2{-})_n{-}A$, wherein A is an n-valent organic group containing at least one hydroxy group and n is 2,3 or 4.

The light-sensitive material of this invention can be advantageously used in high temperature processing in automatic processors which include transporting rollers and have good characteristics of resistance to pressure marking.

DETAILED DESCRIPTION OF THE INVENTION

The present invention relates to a light-sensitive silver halide photographic element comprising a support and at least one silver halide emulsion layer, wherein at least one silver halide emulsion layer contains tabular silver halide grains having an average diameter:thickness ratio of at least 3:1 and highly deionized gelatin hardened with a compound of formula $(CH_2{=}CH{-}SO_2{-})_n{-}A$, wherein A is an n-valent organic group containing at least one hydroxy group and n is 2,3 or 4.

In the above general formula, the group A represents an n-valent acyclic hydrocarbon group, a 5 or 6 membered heterocyclic group containing a nitrogen, oxygen or sulfur atom, a 5 or 6 membered alicyclic group or at least one 7 carbon atom (up to 10 carbon atom) aralkylene group. Each of those groups represented by A may either have a substituent or combine with each other through a hetero atom, for example, a nitrogen, oxygen and/or sulfur atom, or a carbonyl or carbonamido group.

In the above general formula, the group A may be advantageously any organic divalent group, preferably an acyclic hydrocarbon group such as an alkylene group having 1 to 8 carbon atoms, e.g., a methylene group, an ethylene group, a trimethylene group, a tetramethylene group, etc., or an aralkylene group having a total of 8 to 10 carbon atoms. One to three of the carbon atoms of the group defined above for A can be replaced by a hetero atom such as a nitrogen atom, an oxygen atom, a sulfur atom, etc. Also, the group A can be additionally substituted, for example, with one or more alkoxy groups having 1 to 4 carbon atoms such as a methoxy group, an ethoxy group, etc., a halogen atom such as a chlorine atom, a bromine atom, etc., an acetoxy group and the like.

The above hydroxy substituted vinylsulfonyl hardeners can be prepared using known methods, e.g., methods similar to those described in U.S. Pat. No. 4,173,481.

Examples of compounds represented by the above given formula are given below. It is, however, to be understood that the invention shall not be limited thereto.

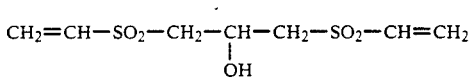

1.

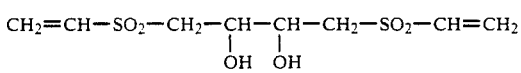

2.

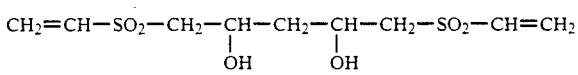

3.

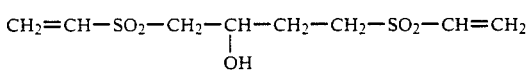

4.

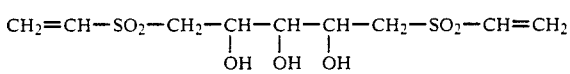

5.

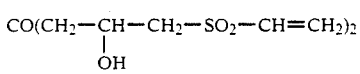

6.

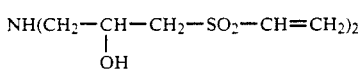

7.

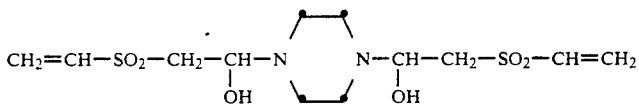

8.

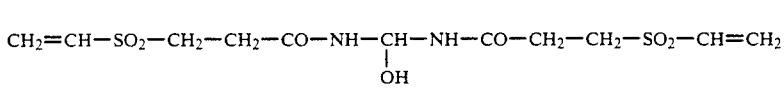

9.

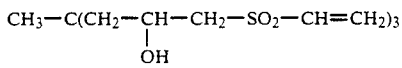

10.

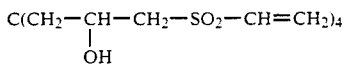

11.

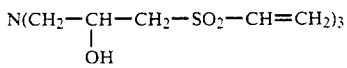

12.

-continued

13.

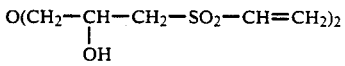

14.

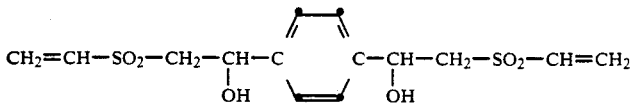

15.

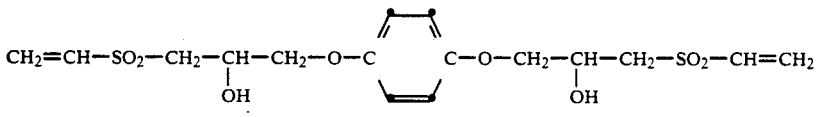

16.

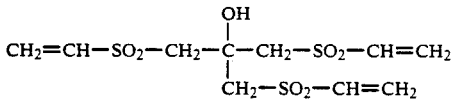

17.

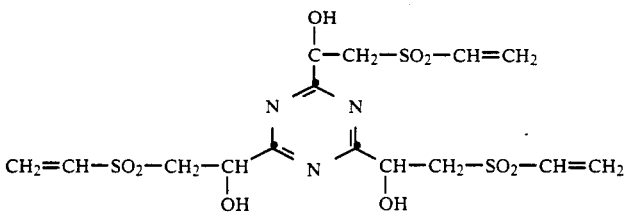

18.

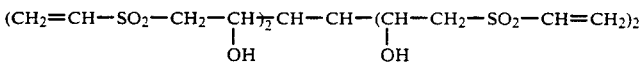

19.

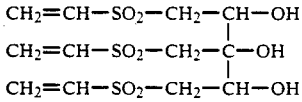

The above hydroxy-substituted vinylsufone compounds may be incorporated in the tabular silver halide emulsion layer comprising the deionized gelatin or in a layer of the light-sensitive silver halide photographic element having a water-permeable relationship with the tabular silver halide emulsion layer. Preferably, the hydroxy substituted vinylsufone compounds are incorporated in the tabular silver halide emulsion layer.

The amount of the above-mentioned hydroxy substituted vinylsufone hardeners that is used in the tabular silver halide emulsion of the photographic material of this invention can be widely varied. Generally, an amount of from 0.5 to 50 mg of the hydroxy substituted vinylsufone hardener per gram of highly deionized gelatin is used, although the preferred concentration range is from 1 to 25 mg of the hydroxy substituted vinylsufone hardener per gram of highly deionized gelatin.

The pressure marking resistance according to the present invention can also be satisfied by using a mixture of the above-mentioned vinylsufone hardeners and a conventionally known hardener, provided that the beneficial effects of the inventiom are not destroyed. For example, aldehyde hardeners, such as formaldehye, glutaraldehyde and the like, active halogen hardeners, such as 2,4-dichloro-6-hydroxy-1,3,5-triazine, 2-chloro-4,6-hydroxy1,3,5-triazine and the like, active vinyl hardeners, such as bisvinylsulfonyl-methane, 1,2-vinylsulfonyl-ethane, bisvinylsulfonyl-methyl ether, 1,2-bisvinylsulfonyl-ethyl ether and the like, N-methylol hardeners, such as dimethylolurea, methyloldimethyl hydantoin and the like, provided that the invention may not affected.

The hydroxy substituted vinylsufone hardeners can be added to the silver halide emulsion layer containing said tabular silver halide grains and the highly deionized gelatin or other components layers of the photographic element utilizing any of the well-known techniques in emulsion making. For example, they can be dissolved in either water or a water-miscible solvent as methanol, ethanol, etc. and added into the coating composition for the above-mentioned silver halide emulsion layer or auxiliary layers.

The highly deionized gelatin which can be used for the purposes of the present invention is characterized by a higher deionization with respect to the commonly used photographic gelatins. Preferably, the gelatin for use in the present invention is almost completely deionized which is defined as meaning that it presents less than 50 ppm (parts per million) of $Ca^{++}$ ions and is practically free (less than 5 parts per million) of other ions such as chlorides, phosphates, sulfates and nitrates, compared with commonly used photographic gelatins having up to 5,000 ppm of $Ca^{++}$ ions and the significant presence of other ions.

The highly deionized gelatin can be employed not only in the silver halide emulsion layer or layers containing tabular silver halide grains, but also in other component layers of the photographic element, such as silver halide emulsion layer or layers containing other than tabular silver halide grains, overcoat layers, interlayers and layers positioned beneath the emulsion layers. In the present invention, preferably at least 50%, more preferably at least 70% of the total hydrophilic colloid of the photographic element comprises highly deionized gelatin.

The tabular silver halide grains contained in the silver halide emulsion layers of this invention have an average diameter:thickness ratio (often referred to in the art as aspect ratio) of at least 3:1, preferably 5:1 to 30:1 and more preferably 7:1 to 15:1. Average diameters of the tabular silver halide grains suitable for use in this invention range from about 0.3 to about 5 micrometeres, preferably 0.5 to 3 micrometers, more preferably 0.8 to 1.5 micrometers. The tabular silver halide grains suitable for use in this invention have a thickness of less than 0.4 micrometers, preferably less than 0.3 micrometers and more preferably less than 0.2 micrometers.

The tabular silver halide grain characteristics described above can be readily ascertained by procedures well known to those skilled in the art. The term "diameter" is defined as the diameter of a circle having an area equal to the projected area of the grain. The term "thickness" means the distance between two substantially parallel main planes constituting the tabular silver halide grains. From the measure of diameter and thickness of each grain the diameter:thickness ratio of each grain can be calculated, and the diameter:thickness ratios of all tabular grains can be averaged to obtain their average diameter:thickness ratio. By this definition the average diameter:thickness ratio is the average of individual tabular grain diameter:thickness ratios. In practice, it is simpler to obtain an average diameter and an average thickness of the tabular grains and to calculate the average diameter:thickness ratio as the ratio of these two averages. Whatever the used method may be, the average diameter:thickness ratios obtained do not greatly differ.

In the silver halide emulsion layer containing tabular silver halide grains of the invention, at least 40% of the silver halide grains are tabular grains having an average diameter:thickness ratio of at least 3:1. More preferably, at least 70% of the silver halide grains are tabular grains having an average diameter:thickness ratio of not less than 3:1. Each of the above proportions, "40%" and "70%" means the proportion of the total projected area of the tabular grains having a diameter:thickness ratio of at least 3:1 to the projected area of all of the silver halide grains in the layer. Other conventional silver halide grain structures such as cubic, orthorhombic, tetrahedral, etc. may make up the remainder of the grains.

In the present invention, commonly employed halogen compositions of the silver halide grains can be used. Typical silver halides include silver chloride, silver bromide, silver iodide, silver chloroiodide, silver bromoiodide, silver chlorobromoiodide and the like. However, silver bromide and silver bromoiodide are preferrd silver halide compositions for tabular silver halide grains with silver bromoiodide compositions containing from 0 to 10 mol % silver iodide. The halogen composition of individual grains may be homogeneous or heterogeneous.

Silver halide emulsions containing tabular silver halide grains can be prepared by various processes known for the preparation of photographic materials. Silver halide emulsions can be prepared by the acid process, neutral process or ammonia process. In the stage for the preparation, a soluble silver salt and a halogen salt can be reacted in accordance with the single jet process, double jet process, reverse mixing process or a combination process by adjusting the conditions in the grain formation, such as pH, pAg, temperature, form and scale of the reaction vessel, and the reaction method. A silver halide solvent, such as ammonia, thioethers, thioureas, etc., may be used, if desired, for controlling grain size, form of the grains, particle size distribution of the grains, and the grain-growth rate.

Preparation of silver halide emulsions containing tabular silver halide grains is described, for example, in de Cugnac and Chateau, "Evolution of the Morphology of Silver Bromide Crystals During Physical Ripening", Science and Industries Photographiques, Vol. 33, No.2 (1962), pp.121-125, in Gutoff, "Nucleation and Growth Rates During the Precipitation of Silver Halide Photographic Emulsions", Photographic Science and Engineering, Vol. 14, No. 4 (1970), pp. 248-257, in Berry et al., "Effects of Environment on the Growth of Silver Bromide Microcrystals", Vol.5, No.6 (1961), pp. 332-336, in U.S. Pat. Nos. 4,063,951, 4,067,739, 4,184,878, 4,434,226, 4,414,310, 4,386,156, 4,414,306 and in EP patent application no. 263,508.

In preparing the silver halide emulsions containing tabular silver halide grains, a wide variety of hydrophilic dispersing agents for the silver halides can be employed in addition to the highly deionized gelatin. Gelatin as described hereinbefore is preferred, although other colloidal materials such as gelatin derivatives, colloidal albumin, cellulose derivatives or synthetic hydrophilic polymers can be used as known in the art.

The silver halide emulsions containing tabular silver halide grains used in the present invention can be chemically and optically sensitized by known methods. The silver halide emulsion layer containing the tabular silver halide grains of this invention can contain other constituents generally used in photographic products, such as binders, hardeners, surfactants, speed-increasing agents, stabilizers, plasticizers, optical sensitizers, dyes, ultraviolet absorbers, etc., and reference to such components can be found, for example, in Research Disclosure, Vol. 176 (December 1978), pp. 22-28. Ordinary silver halide grains may be incorporated in the emulsion layer containing the tabular silver halide grains as well as in other silver halide emulsion layers of the light-sensitive silver halide photographic material of this invention. Such grains can be prepared by processes well known in the photographic art.

The light-sensitive silver halide photographic material of this invention can be prepared by coating the light-sensitive silver halide emulsion layer or layers and other auxiliary layers on a support. Examples of materials suitable for the preparation of the support include glass, paper, polyethylene-coated paper, metals, polymeric films such as cellulose nitrate, cellulose acetate, polystyrene, polyethylene terephthalate, polyethylene, polypropylene and other well known supports.

The light-sensitive silver halide photographic materials of this invention are applicable to light-sensitive photographic color materials such as color negative films, color reversal films, color papers, etc., as well as black-and-white light-sensitive photographic materials such as X-ray light-sensitive materials, lithographic light-sensitive materials, black-and-white photographic printing papers, black-and-white negative films, graphic arts films, etc.

Preferred light-sensitive silver halide photographic materials according to this invention are radiographic light-sensitive materials used in X-ray imaging comprising a silver halide emulsion layer(s) coated on one surface, preferably on both surfaces of a support, preferably a polyethylene terephthalate support, wherein at least one of said silver halide emulsion layers contains tabular silver halide grains having an average diameter:-thickness ratio of at least 3:1 and highly deionized gelatin hardened with the above mentioned hydroxy substituted vinylsufone hardeners. Preferably, the silver halide emulsions are coated on the support at a total silver coverage in the range of 3 to 6 grams per square meter. Usually, the radiographic light-sensitive materials are associated with intensifying screens so as to be exposed to radiation emitted by said screens. The screens are made of relatively thick phosphor layers which transform the X-rays into more imaging-effective radiation such as light (e.g., visible light). The screens absorb a much larger portion of X-rays than the light-sensitive materials do and are used to reduce the X-ray dose necessary to obtain a useful image. According to their chemical composition, the phosphors can emit radiation in the ultraviolet, blue, green or red region of the visible spectrum and the silver halide emulsions are sensitized to the wavelength region of the radiation emitted by the screens. Sensitization is performed by using spectral sensitizing dyes adsorbed on the surface of the silver halide grains as known in the art.

More preferred light-sensitive silver halide photographic materials according to this invention are radiographic light-sensitive materials which employ one or more high diameter:thickness ratio tabular grain silver halide emulsions or intermediate diameter:thickness ratio tabular grain silver halide emulsions, as disclosed in U.S. Pat. Nos. 4,425,425 and 4,425,426 and in EP patent application no. 84,637.

The exposed light-sensitive materials of this invention can be processed by any of the conventional processing techniques. The processing can be black-and-white photographic processing for forming a silver image or color photographic processing for forming a dye image depending upon the purpose. Such processing techniques are illustrated for example in Research Disclosure, 17643, December 1978. Roller transport processing in an automatic processor is illustrated in U.S. Pat. Nos. 3,025,779, 3,515,556, 3,545,971 and 3,647,459 and in UK Pat. No. 1,269,268. Hardening development can be undertaken, as illustrated in U.S. Pat. No. 3,232,761.

The present invention reduces pressure marking in photographic elements comprising silver halide emulsion layer(s) containing tabular silver halide grains. This invention, in particular, is effective for high temperature, accelerated processing with automatic processors wherein the element is transported automatically and at constant speed from a processing unit to other by means of rollers. Generally, the first unit is the developing unit and preferably the developing bath is a developing-hardening bath. In this type of developing bath, the hardening agent is an aldehyde compound, in particular an aliphatic dialdehyde compound of the glutaraldehyde, maleic dialdehyde, succinaldehyde, etc. type, used as they are or in the form of bisulfite addition compounds as described in GB Pat. No. 825,544.

The following examples, which better illustrate the present invention, report some experimental data obtained with processing and measurements of normal use in the art. In particular, as regards the resistance to the roller marking and turbidity, samples of the films in the form of sheets were stored for 15 hours at 50° C., exposed to white light and processed in a 3M Trimatic TM XP515 automatic processor, by developing for 27 seconds at 35° C. with a 3M XAD2 developer, then fixing for 27 seconds at 30° C. with a 3M XAF2 fixer, washing with water for 22 seconds at 35° C. and drying for 22 seconds at 35° C.

The transporting rollers of the developing unit were intentionally deformed to produce an area of elevated pressure onto the film. At the end of the processing, the roller pressure caused black marks which were more or less evident according to the tendency of the film to register more or less the defect: a scholastic evaluation was given to the film resistance to pressure marking and turbidity by giving a 3-mark to those films which had many pressure marking defects and were very turbid, an 8-mark to those films which had no defects and intermediate marks to intermediate situations.

The swelling index was measured as ratio of thickness obtained by dipping film samples in water at 20° C. for 5 minutes and the thickness of dry film samples.

The hardness was measured with an instrument provided with a stylus which engraves the sample imbibed for a given time at a given temperature into a liquid composition (water or developing solution). The hardness values are expressed in grams loaded on the stylus to engrave the sample: the higher the weight, the higher the hardness of the element.

EXAMPLE 1

A tabular grain silver bromide emulsion (having an average diameter:thickness ratio of 8:1, prepared in the presence of a deionized gelatin having a viscosity at 60° C. in water at 6.67% w/w of 4.6 mPas, a conducibility at 40° C. in water at 6.67% w/w of less than 150 μS/cm and less than 50 ppm of $Ca^{++}$ was optically sensitized to green light with a cyanine dye and chemically sensitized with sodium p-toluenethiosulfonate, sodium p-toluenesulfinate and benzothiazoleiodoethylate. At the end of the chemical digestion, non-deionized gelatin (having a viscosity at 60° C. in water at 6.67% w/w of 5.5 mPas, a conducibility at 40° C. in water at 6.67% w/w of 1,100 μS/cm and 4,500 ppm of $Ca^{++}$ was added to the emulsion in an amount to have 83% by weight of deionized gelatin and 17% by weight of non-deionized gelatin. The emulsion, containing a wetting agent and 5-methyl-7-hydroxytriazaindolizine stabilizer, was divided into four portions. The four portions were added with the hardener indicated in Table 1. Each portion was coated, at the indicated pH, on each side of a blue polyester film support at a silver coverage of 2 g/m² and gelatin coverage of 1.6 g/m² per side. A non deionized gelatin protective supercoat containing 1.1 g/m² of gelatin per side and the hardener indicated in Table 1 was applied on each coating at the pH of the emulsion (films A to D).

The sensitometric and physical results are tabulated in the following Table 1.

TABLE 1

| Film | A (Comp.) | B (Inv.) | C (Comp.) | D (Inv.) |
|---|---|---|---|---|
| Coating pH | 8.2 | 8.2 | 6.7 | 6.7 |
| Bisvinylsulfonylethyl-ether (hardener) g/m²: | | | | |
| emulsion layer | 0.11 | / | 0.11 | / |
| protective layer | 0.064 | / | 0.064 | / |
| 1,3-Bisvinylsufonyl-2-propanol (hardener) g/m²: | | | | |
| emulsion layer | / | 0.11 | / | 0.11 |
| protective layer | / | 0.064 | / | 0.064 |

TABLE 1-continued

| Film | A (Comp.) | B (Inv.) | C (Comp.) | D (Inv.) |
|---|---|---|---|---|
| D.min | 0.21 | 0.21 | 0.20 | 0.20 |
| Blue speed* | 2.01 | 2.00 | 1.99 | 1.98 |
| Green speed* | 2.42 | 2.40 | 2.40 | 2.38 |
| T8 speed* | 2.55 | 2.54 | 2.53 | 2.52 |
| Average contrast | 2.40 | 2.40 | 2.50 | 2.50 |
| Hardness: | | | | |
| water | 44 | 45 | 39 | 40 |
| developer | 47 | 53 | 41 | 46 |
| Swelling index | 2.6 | 2.4 | 2.8 | 2.6 |
| Pressure marking | 5 | 8 | 3 | 8 |
| Turbidity | 5 | 8 | 3 | 8 |

*Blue speed and Green speed are the relative sensitivities expressed in logE (wherein E is the exposure in meter-candle-seconds) for films exposed, respectively, to blue and green light, and T8 speed is the relative sensitivity for films exposed to X-rays in contact with 3M Trimax TM T8

We claim:

1. Light-sensitive silver halide photographic elements comprising a support and at least one silver halide emulsion layer, wherein at least one silver halide emulsion layer contains tabular silver halide grains having an average diameter of 0.3 to 5 micrometers and an average diameter:thickness ratio of at least 3:1 and highly deionized gelatin having a $Ca^{+2}$ content less than 50 ppm, and hardened with a vinylsulfone compound of formula $(CH_2{=}CH{-}SO_2{-})_n{-}A$, wherein A is an n-valent organic group containing at least one hydroxy group and n is 2,3 or 4.

2. The light-sensitive silver halide photographic elements of claim 1, wherein the group A represents a n-valent acyclic hydrocarbon group, a 5 or 6 membered heterocyclic group containing a nitrogen, oxygen or sulfur atom, a 5 or 6 membered alicyclic group or aralkylene group.

3. The light-sensitive silver halide photographic elements of claim 1, wherein n is 2 and the group A is a divalent acyclic hydrocarbon group having 1 to 8 carbon atoms, or an aralkylene group having a total of 8 to 10 carbon atoms.

4. The light-sensitive silver halide photographic elements of claim 1, wherein said vinylsulfone compound is used in an amount of from 0.5 to 50 mg per gram of highly deionized gelatin.

5. The light-sensitive silver halide photographic elements of claim 1, wherein said tabular silver halide grains have an average diameter:thickness ratio of 5:1 to 30:1.

6. The light-sensitive silver halide photographic elements of claim 1, wherein said tabular silver halide grains have an average thickness of 0.4 micrometers or less.

7. The light-sensitive silver halide photographic elements of claim 1, wherein not less than 40% of the silver halide grains are tabular silver halide grains having an average diameter:thickness ratio of at least 3:1.

8. A light-sensitive silver halide element for use in radiography with intensifying screens comprising a transparent support having coated on both sides silver halide emulsion layers, wherein at least one of said silver halide emulsion layers contains tabular silver halide grains having an average diameter:thickness ratio of at least 3:1 and highly deionized gelatin having a $Ca^{+2}$ content less than 50 ppm, and hardened with a vinylsulfone compound of formula $(CH_2{=}CH{-}SO_2{-})_n{-}A$, wherein A is an n-valent organic group containing at least one hydroxy group and n is 2,3 or 4.

9. Light-sensitive silver halide photographic elements comprising a support and at least one silver halide emulsion layer, wherein at least one silver halide emulsion layer contains tabular silver halide grains having an average diameter of from 0.5 to 3 micrometers and an average diameter:thickness ratio of at least 3:1 and highly deionized gelation having a $Ca^{+2}$ content less than 50 ppm, and with a vinylsulfone compound of formula $(CH_2{=}CH{-}SO_2{-})_n{-}A$, wherein A is an n-valent organic group containing at least one hydroxy group and n is 2, 3 or 4.

10. The light-sensitive silver halide photographic elements of claim 9, wherein the group A represents a n-valent acyclic hydrocarbon group, a 5 or 6 membered heterocyclic group containing a nitrogen, oxygen or sulfur atom, a 5 or 6 membered alicyclic group or aralkylene group.

11. The light-sensitive silver halide photographic elements of claim 9, wherein n is 2 and the group A is a divalent acyclic hydrocarbon group having 1 to 8 carbon atoms, or an aralkylene group having a total of 8 to 10 carbon atoms.

12. The light-sensitive silver halide photographic elements of claim 9, wherein said vinylsufone compound is used in an amount of from 0.5 to 50 mg per gram of highly deionized gelation.

13. The light-sensitive silver halide photographic elements of claim 9, wherein said tabular silver halide grains have an average diameter:thickness ratio of 5:1 to 30:1.

14. The light-sensitive silver halide photographic elements of claim 9 wherein said tabular silver halide grains have an average thickness of 0.4 micrometers or less.

15. The light-sensitive silver halide photographic elements of claim 9, wherein not less than 40% of the silver halide grains are tabular silver halide grains having an average diameter:thickness ratio of at least 3:1.

* * * * *

UNITED STATES PATENT AND TRADEMARK OFFICE

CERTIFICATE OF CORRECTION

PATENT NO. : 5,246,824

DATED : September 21, 1993

INVENTOR(S) : Delfino et al.

It is certified that error appears in the above-indentified patent and that said Letters Patent is hereby corrected as shown below:

Column 12, line 22, delete "gelation" and insert --gelatin--.

Column 12, line 41, delete "gelation" and insert --gelatin--.

Column 12, line 23, after "and" insert -- hardened --.

Signed and Sealed this

Twenty-seventh Day of September, 1994

*Attest:*

Bruce Lehman

BRUCE LEHMAN

*Attesting Officer*

*Commissioner of Patents and Trademarks*